US011136747B2

(12) United States Patent
Prevost et al.

(10) Patent No.: US 11,136,747 B2
(45) Date of Patent: Oct. 5, 2021

(54) COOLING SYSTEM FOR WATER-COOLED APPARATUS

(71) Applicant: SYSTEMES MCED INC., Les Coteaux (CA)

(72) Inventors: Guillaume Prevost, Salaberry-de Valleyfield (CA); Eric Debonville, Coteau-du-lac (CA); Mathieu Castonguay, Coteau-du-lac (CA)

(73) Assignee: SYSTEMES MCED INC., Les Coteaux (CA)

( * ) Notice: Subject to any disclaimer, the term of this patent is extended or adjusted under 35 U.S.C. 154(b) by 202 days.

(21) Appl. No.: 16/400,464

(22) Filed: May 1, 2019

(65) Prior Publication Data

US 2020/0181890 A1 Jun. 11, 2020

Related U.S. Application Data

(60) Provisional application No. 62/777,010, filed on Dec. 7, 2018.

(51) Int. Cl.

| | |
|---|---|
| ***F25D 17/00*** | (2006.01) |
| ***E03B 1/04*** | (2006.01) |
| ***F28F 27/02*** | (2006.01) |
| ***E03B 7/07*** | (2006.01) |
| ***E03B 7/00*** | (2006.01) |
| ***E03B 11/00*** | (2006.01) |

(Continued)

(52) U.S. Cl.

CPC ..... *E03B 1/048* (2013.01); *E03B 7/00* (2013.01); *E03B 7/003* (2013.01); *E03B 7/07* (2013.01); *E03B 7/075* (2013.01); *E03B 11/00* (2013.01); *F28F 27/02* (2013.01); *F24F 2005/006* (2013.01); *F25B 39/00* (2013.01); *F25B 2339/047* (2013.01); *F25D 1/02* (2013.01)

(58) Field of Classification Search

CPC . E03B 1/048; E03B 7/00; E03B 7/003; E03B 7/07; E03B 7/075; E03B 11/00; F28F 27/02; F24F 2005/006; F25B 39/00; F25B 2339/048; F25D 1/02

USPC ..... 62/189

See application file for complete search history.

(56) References Cited

U.S. PATENT DOCUMENTS 4,324,109 A * 4/1982 Garland ..... F25C 5/10 62/353

4,373,345 A * 2/1983 Tyree, Jr. ..... F24D 17/02 62/183

(Continued)

*Primary Examiner* — Claire E Rojohn, III

(74) *Attorney, Agent, or Firm* — Norton Rose Fulbright Canada LLP

(57) ABSTRACT

There is disclosed a system for cooling a water-cooled apparatus having a water inlet and a water outlet. The system has: a circuit in fluid communication with the water inlet and the water outlet, the circuit having a valve upstream of the water inlet connected to a source of water, and an outlet in fluid communication with a sewer; an air-cooled cooling unit in heat exchange relationship with water in the circuit; and a pump fluidly connected to the circuit; the system operable between a closed-loop configuration and an open configuration, the valve being closed and the pump circulating water between the water-cooled apparatus and the air-cooled cooling unit in the closed-loop configuration, and the valve being open and water in the circuit circulating from the source of water, through the water-cooled apparatus, and to the sewer in the open configuration.

20 Claims, 9 Drawing Sheets

(51) Int. Cl.

| | |
|---|---|
| *F25B 39/00* | (2006.01) |
| *F24F 5/00* | (2006.01) |
| *F25D 1/02* | (2006.01) |

(56) References Cited

U.S. PATENT DOCUMENTS 4,378,680 A * 4/1983 Garland ..... F25C 5/10 62/278
4,625,524 A * 12/1986 Kimura ..... F25B 47/006 62/278
4,774,815 A * 10/1988 Schlosser ..... F25B 41/20 62/149
4,878,361 A * 11/1989 Kohl ..... F25B 47/022 62/352
4,907,422 A * 3/1990 Kohl ..... F25B 47/022 62/278
5,058,395 A * 10/1991 Ni ..... F25B 41/20 62/278
5,167,130 A * 12/1992 Morris, Jr. ..... F25B 1/047 62/196.1
5,174,123 A * 12/1992 Erickson ..... F25B 1/047 62/113
5,218,830 A * 6/1993 Martineau ..... F25C 5/10 62/160
5,363,671 A * 11/1994 Forsythe ..... F25C 1/04 62/197
5,743,098 A * 4/1998 Behr ..... F25B 41/22 62/80
5,755,106 A * 5/1998 Ross ..... A23G 9/08 62/217
5,787,723 A * 8/1998 Mueller ..... F25C 1/12 62/347
5,842,352 A * 12/1998 Gregory ..... F25B 47/022 62/206
6,009,715 A * 1/2000 Sakurai ..... F25B 39/04 62/197
6,145,324 A * 11/2000 Dolezal ..... F25C 5/10 62/348
6,196,007 B1 * 3/2001 Schlosser ..... F25B 5/02 62/278
6,637,227 B2 * 10/2003 Stensrud ..... F25C 1/00 62/217
7,017,353 B2 * 3/2006 Gist ..... F25B 47/022 62/73
9,121,631 B2 * 9/2015 Cho ..... F25B 49/027
9,410,254 B2 * 8/2016 Samrgandi ..... C25B 15/02
9,638,435 B2 * 5/2017 Ambriz ..... F24F 11/30
9,861,955 B2 * 1/2018 Romig ..... B01D 53/0462
10,132,577 B2 * 11/2018 Martell ..... F28D 1/024
2011/0289951 A1 * 12/2011 Furlong ..... F28C 1/14 62/171

* cited by examiner

COOLING SYSTEM FOR WATER-COOLED APPARATUS

CROSS-REFERENCE TO RELATED APPLICATIONS

This application claims priority of U.S. provisional application No. 62/777,010 filed Dec. 7, 2018, the entire content of which is incorporated by reference herein.

TECHNICAL FIELD

The application relates generally to water-cooled apparatuses such as refrigerators and, more particularly, to systems and methods used for cooling such water-cooled apparatuses.

BACKGROUND

A plurality of devices such as refrigerators and ice cream machines are water-cooled. That is, those machines have a water inlet that is fluidly connected to a source of water and a water outlet that is fluidly connected to a sewer. Typically, the water inlet is a source of drinkable water such as a municipal source of tap water. The cold tap water is circulated in the water-cooled apparatus, heat from the water-cooled apparatus is transferred to the water, and the water thereby heated is rejected to the sewer. Therefore, it is not an environmentally friendly process since drinkable water is simply wasted. Some regulations in some countries or municipalities may prevent the use of tap water for operating their water-cooled apparatus. Although there might be some air-cooled equivalent, these may be very expensive and it may not be a viable solution to simply replace water-cooled apparatuses that are still operational.

SUMMARY

There is provided a system for cooling a water-cooled apparatus having a water inlet and a water outlet, the system comprising: a circuit in fluid communication with the water inlet and the water outlet of the water-cooled apparatus, the circuit having a valve upstream of the water inlet connected to a source of water, and an outlet in fluid communication with a sewer; an air-cooled cooling unit in heat exchange relationship with water in the circuit; and a pump fluidly connected to the circuit for circulating the water to and from the air-cooled cooling unit; the system operable between a closed-loop configuration and an open configuration, the valve being closed and the pump circulating water between the water-cooled apparatus and the air-cooled cooling unit in the closed-loop configuration, and the valve being open and water in the circuit circulating from the source of water, through the water-cooled apparatus, and to the sewer in the open configuration.

There is provided a method of cooling a refrigerating device, comprising: transferring heat generated by the device to water circulating in the device; cooling the heated water exiting the device with air; circulating the cooled water back to the device and repeatedly cooling the heated water exiting the device with air when a temperature of the cooled water is below a temperature threshold; and fluidly connecting the device to receive water from a municipal water source and to reject the heated water to a sewer when a temperature of the cooled water is above the temperature threshold.

There is provided a method of retrofitting a water-cooled apparatus fluidly connected to receive water from a source of water and to expel water to a sewer, the method comprising: forming a closed-loop by fluidly connecting an inlet and an outlet of the water-cooled apparatus in heat exchange relationship with an air-cooled cooling unit, and by positioning a valve between the source of water and the inlet of the water-cooled apparatus.

There is provided a cooling system comprising: a water-cooled apparatus having a water inlet and a water outlet; a circuit in fluid communication with the water inlet and the water outlet, the circuit having a valve upstream of the water inlet connected to a source of water, and an outlet in fluid communication with a sewer; an air-cooled cooling unit in heat exchange relationship with water in the circuit; and a pump fluidly connected to the circuit for circulating the water to and from the air-cooled cooling unit; the system operable between a closed-loop configuration and an open configuration, the valve being closed and the pump circulating water between the water-cooled apparatus and the air-cooled cooling unit in the closed-loop configuration, and the valve being open and water in the circuit circulating from the source of water, through the water-cooled apparatus, and to the sewer in the open configuration.

DESCRIPTION OF THE DRAWINGS

Reference is now made to the accompanying figures in which.

DETAILED DESCRIPTION

Figure 1:
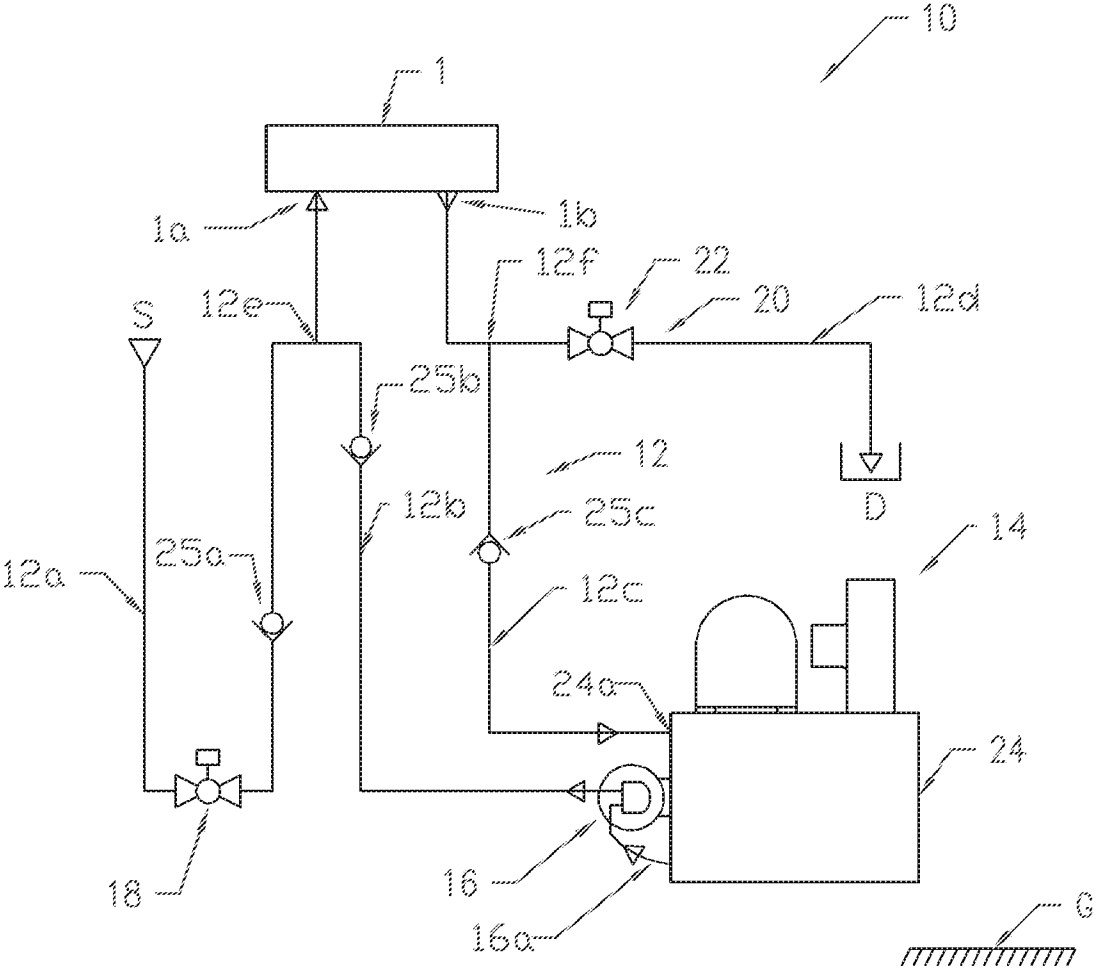
FIG. 1 is a schematic view of a system for cooling a water-cooled apparatus in accordance with one embodiment.

A system for cooling a water-cooled apparatus is generally shown at 10. The water-cooled apparatus 1 includes a water inlet 1*a* and a water outlet 1*b*. The water-cooled apparatus 1 may be, for instance, an ice cream machine, a refrigerator, a freezer. The water-cooled apparatus may be any apparatus having a heat pump therein; the heat pump extracting heat from a medium (e.g., air within the refrigerator) and transferring the extracted heat to water circulating therein. Any water-cooled heat pump known in the art may be used in the water-cooled apparatus 1. Typically, the heat pump of the water-cooled apparatus 1 includes a refrigerant circuit circulating a refrigerant. The heat transfer from the medium to the water is done via the refrigerant. More specifically, the refrigerant changes phase from a liquid phase to a gas phase when circulating through the medium thereby picking up a portion of the heat of the medium and changes phase from the gas phase back to the liquid phase thereby transferring the picked up heat to the water.

In some cases, the water inlet 1*a* is directly fluidly connected to a water source S and the water outlet 1*b* is directly fluidly connected to a sewer D. Cooling the water-cooled apparatus 1 using tap water represents a substantial waste from an environmental perspective as the tap water that has been treated to become drinkable water is simply returned to the sewer D after cooling down the water-cooled apparatus 1.

In the embodiment shown, the system 10 includes a circuit 12 that is used for circulating water to the water inlet 1*a* of the water-cooled apparatus 1 and from the water outlet 1*b* of the water-cooled apparatus 1. The circuit 12 may define a closed-loop in which the water circulating therein is re-circulated to the water-cooled apparatus 1 after being cooled. The system 10 further includes an air-cooled cooling unit 14. The air-cooled cooling unit 14 is in a heat-exchange relationship with the water in the circuit 12. More details about the air-cooled cooling unit 14 are presented below with references to FIGS. 2 and 3. The system 10 further includes a pump 16 that is fluidly connected to the circuit 12 for driving a flow of the water in the circuit 12 and through the air-cooled cooling unit 14.

The circuit 12 may define a closed loop in which water that is cooled by the air-cooled cooling unit 14 is injected in the water-cooled apparatus 1 via its water inlet 1*a*. Once it has been heated by the water-cooled apparatus 1, the water is extracted from the apparatus 1 from its water outlet 1*b* and redirected toward the air-cooled cooling unit 14 to be once again cooled. This cycle may repeat itself as long as the water-cooled apparatus 1 is running. The disclosed system 10 then might therefore allow to transform the water-cooled apparatus 1 into an air-cooled one because of the use of the air-cooled cooling unit 14.

However, in some cases, the cooling power of the air-cooled cooling unit 14 might be insufficient for cooling the water-cooled apparatus 1. This might happen, for instance, if the water-cooled apparatus 1 is an ice cream machine being operated during a hot summer day. In this case, the air-cooled cooling unit 14 might be insufficient to extract heat from the refrigerant of the heat pump of the ice cream machine. Therefore, it might be advantageous to allow the system 10 to revert to an open-loop system and use water from the water source S, such as tap water, to cool down the apparatus 1 to supplement and/or replace the cooling provided by the air-cooled cooling unit 14 in cooling down the water-cooled apparatus 1.

Still referring to FIG. 1, the system 10 further includes a valve 18. The valve 18 is fluidly connected to the source of water S upstream of the water inlet 1*a* and is operable in a closed configuration in which the source of water S is fluidly disconnected from the sewer D and in an open configuration in which the source of water S is fluidly connected to the sewer D. By opening the valve 18, more water is added to the circuit 12. As shown in FIG. 1, the circuit 12 includes an outlet 20 that is used for expelling excess water from the circuit 12 to the sewer D. In the depicted embodiment, the circuit 12 further includes a second valve 22 that is fluidly connected to the outlet 20 of the circuit 12. The second valve 22 is operable in a closed configuration in which the circuit 12 is fluidly disconnected from the sewer D and in an open configuration in which the circuit 12 is fluidly connected to the sewer D. The valves 18, 22 are shown in their closed configurations in solid lines and in their open configuration in dashed lines.

Still referring to FIG. 1, the circuit 12 includes a reservoir 24 that is used for containing water. The water is held in the reservoir 24 while it is being cooled by the air-cooled cooling unit 14. More details about this configuration are presented herein below with reference to FIGS. 2 and 3. In this embodiment, the water contained in the reservoir 24 is in a heat-exchange relationship with the air-cooled cooling unit 14. The pump 16 has a pump inlet 16*a* that is fluidly connected to the reservoir 24. The reservoir 24 includes a reservoir inlet 24*a* that is fluidly connectable to the water outlet 1*b* of the water-cooled apparatus 1. An elevation from a ground G on the pump inlet 16*a* is in less elevation from the ground G of the reservoir inlet 24*a*. As the water is being cooled in the reservoir 24 by the air-cooled cooling unit 14, colder water may naturally tend to go toward a bottom of the reservoir 24. Consequently, fluidly connecting the pump inlet 16*a* close to the bottom of the reservoir 24 might allow the pump inlet 16*a* to draw the water that is the coldest within the reservoir 24.

In the depicted embodiment, the circuit 12 includes a first conduit 12*a*, a second conduit 12*b*, a third conduit 12*c* and a fourth conduit 12*d*. The first conduit 12*a* fluidly connects the source of water S to the second conduit 12*b* at an intersection, or connection point, 12*e* between the first conduit 12*a* and the second conduit 12*b*. The second conduit 12*b* fluidly connects the pump inlet 16*a* to the water inlet 1*a* of the water-cooled apparatus 1. The third conduit 12*c* fluidly connects the water outlet 1*b* of the water-cooled apparatus 1 to the reservoir inlet 24*a* and the fourth conduit 12*c* fluidly connects the third conduit 12*c* to the sewer D. The fourth conduit 12*d* stems from the third conduit 12*c* at an intersection 12*f* between the third and fourth conduits 12*c*, 12*d*. In the depicted embodiment, the valve 18 is fluidly connected on the first conduit 12*a* between the source of water S and the intersection 12*e* between the first and second conduits 12*a*, 12*b*. The second valve 22 is fluidly connected on the fourth conduit 12*d* downstream of the intersection 12*f* between the third conduit 12*c* and the fourth conduit 12*d* and upstream of the sewer D.

The system 10 further includes a plurality of one-way valves 25*a*, 25*b* and 25*c* that are fluidly connected on the circuit 12. The one-way valves 25*a*, 25*b* and 25*c* are used to ensure a proper flow direction within the circuit 12. The first one-way valve 25*a* is fluidly connected on the first conduit 12*a* downstream of the valve 18 and upstream of the intersection 12*e* between the first and second conduits 12*a*, 12*b*. The second one-way valve 25*b* is fluidly connected on the second conduit 12*b* between the intersection 12*e* between the first and second conduits 12*a*, 12*b* and the pump 16. The third one-way valve 25*c* is fluidly connected on the third conduit 12*c* downstream of the intersection 12*f* between the third and fourth conduits 12*c*, 12*d* and upstream of the reservoir inlet 24*a*. The first one-way valve 25*a* limits the flow of water toward the water source S. The second one-way valve 25*b* limits the flow of water from the water source S to the reservoir 24. The third one-way valve 25*c* limits the flow of water from the reservoir inlet 24*a* toward the water outlet 1*b* of the water-cooled apparatus 1. It is understood that herein, "upstream" and "downstream" are in relation to the flow of water circulating in the circuit 12 from the water outlet 1*b* to the water inlet 1*a* of the water-cooled apparatus 1.

Figure 2:
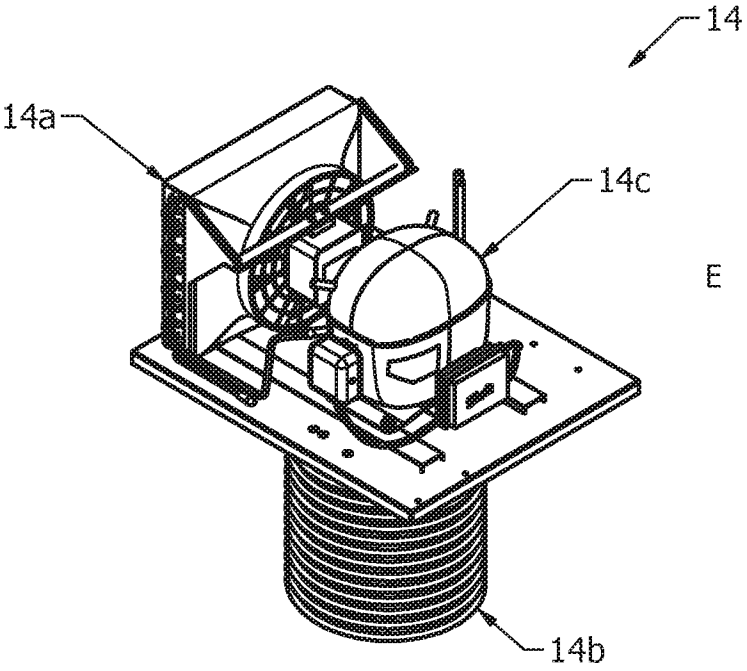
FIG. 2 is a three dimensional view of an air-cooled cooling unit of the system of FIG. 1.
Figure 3:
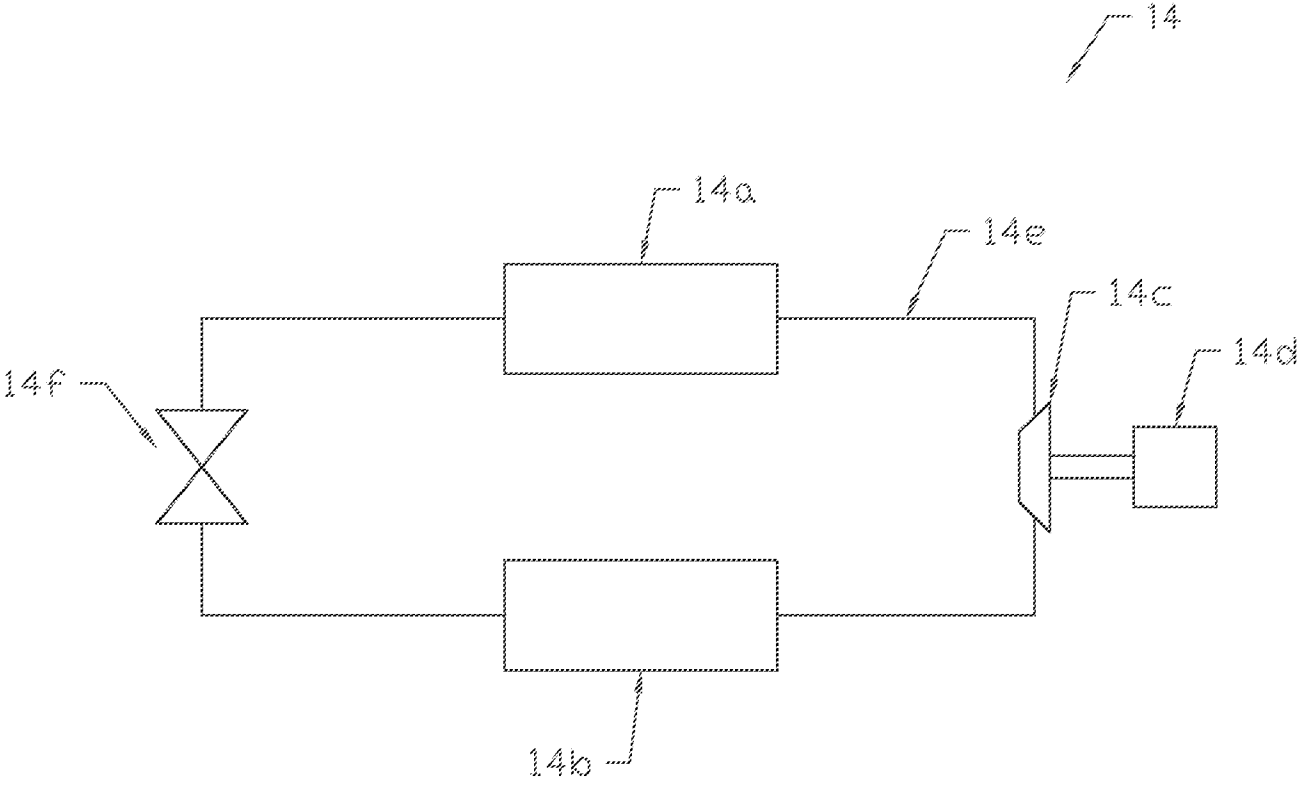
FIG. 3 is a schematic view of the air-cooled cooling unit of FIG. 2.

Referring now to FIGS. 2 and 3, the air-cooled cooling unit 14 is described in more detail. The air-cooled cooling unit 14 includes a condenser 14*a*, an evaporator 14*b*, a compressor 14*c*, an electric motor 14*d* in driving engagement with the compressor 14*c*. The compressor 14*c* is fluidly connected to a refrigerant conduit 14*e* in which flows a liquid refrigerant such as R134a. Any suitable refrigerant known in the art may be used. The evaporator 14*b* corresponds to a portion of the refrigerant conduit 14*e*. The condenser 14*a* of the air-cooled cooling unit 14 is a heat exchanger having at least one first conduit fluidly connected to the refrigerant conduit 14*e* and at least one second conduit in heat exchange relationship with the at least one first conduit and fluidly connected to air of an environment E outside the refrigerant conduit 14*e*. A fan may be used to draw an airflow within the at least one second conduit of the heat exchanger 14*a*.

A temperature and pressure of the liquid refrigerant increases via its compression in the compressor 14*c*. After exiting the compressor 14*c*, the liquid refrigerant is routed into the condenser 14*a*, where it transfers a portion of its heat to air circulating in the at least one second conduit of the heat exchanger and changes phases from gas to liquid. In the embodiment shown, the liquid refrigerant then goes through a regulator (e.g., expansion valve, capillary tubes, etc) 14*f* before being directed through the evaporator 14*b* where the liquid refrigerant absorbs heat from the water in the reservoir 24 and changes phase from liquid to gas. Therefore, the temperature of the water in the reservoir 24 decreases via its contact with the evaporator 14*b*. As the liquid refrigerant that exits the evaporator 14*b* is in a gas phase, it needs to be recompressed by the compressor 14*c* to be reverted back to a liquid phase before being rerouted into the condenser 14*a*. This cycle is repeated.

It is understood that the reservoir 24 is not always required. For instance, the air-cooled cooling unit 14 may be in heat exchange relationship with the water in the circuit 12 via one of the second and third conduits 12*b*, 12*c*. The evaporator 14*b* of the air-cooled cooling unit 14 may be wrapped around a conduit of the circuit 12. In such a case, heat from the water in the conduit is transferred to the conduit via internal convection, from an inner side of the conduit to an outer side of the conduit via conduction and from the outer side of the conduit to the evaporator 14*b*. Alternatively, the evaporator 14*b* may be located within one of the second and third conduits 12*b*, 12*c* such that water that circulates therein gets cooled down when it passes by the evaporator 14*b*. Other configurations are contemplated without departing from the scope of the present disclosure.

In a particular embodiment, the air-cooled-cooling unit 14 is operated when the water-cooled apparatus 1 is not in operation. This allows to cool down the water in the reservoir 24 up to a point where an ice block forms around the evaporator 14. The ice block may provide sufficient thermal capacity to delay the use of the water from the water source during a high demand period (e.g., hot summer day) of the water-cooled apparatus (e.g., ice-cream machine). In some cases, the air-cooled cooling unit 14 is operated at night while the water-cooled apparatus 1 is not operated. This might allow sufficient time for the ice block to form around the accumulator 14*b*. In some cases, the circuit 12 may circulate a mixture of water and glycol to decrease a solidification temperature of the water. In a particular embodiment, a volumetric concentration of the glycol in the water is 40%. It is understood that the volumetric concentration of the glycol may be changed to decrease or increase the freezing temperature of the water-glycol mixture. In a particular embodiment, a volume of the ice block is about 77 liters. It is understood that the volume of the ice block may be changed without departing from the scope of the present disclosure. In a particular embodiment, the air-cooled cooling unit 14 is not in operation when the system 10 is in the open configuration, that is when the reservoir 24 is fluidly disconnected from the water-cooled apparatus 1. Alternatively, the air-cooled cooling unit 14 may remain in operation while the system 10 is in the open configuration to form the ice block and, when the ice block is formed, the system 10 may be reverted to the closed-loop configuration. In a particular embodiment, when the system 10 is in the open configuration, the pump 16 is not in operation.

Figure 4:
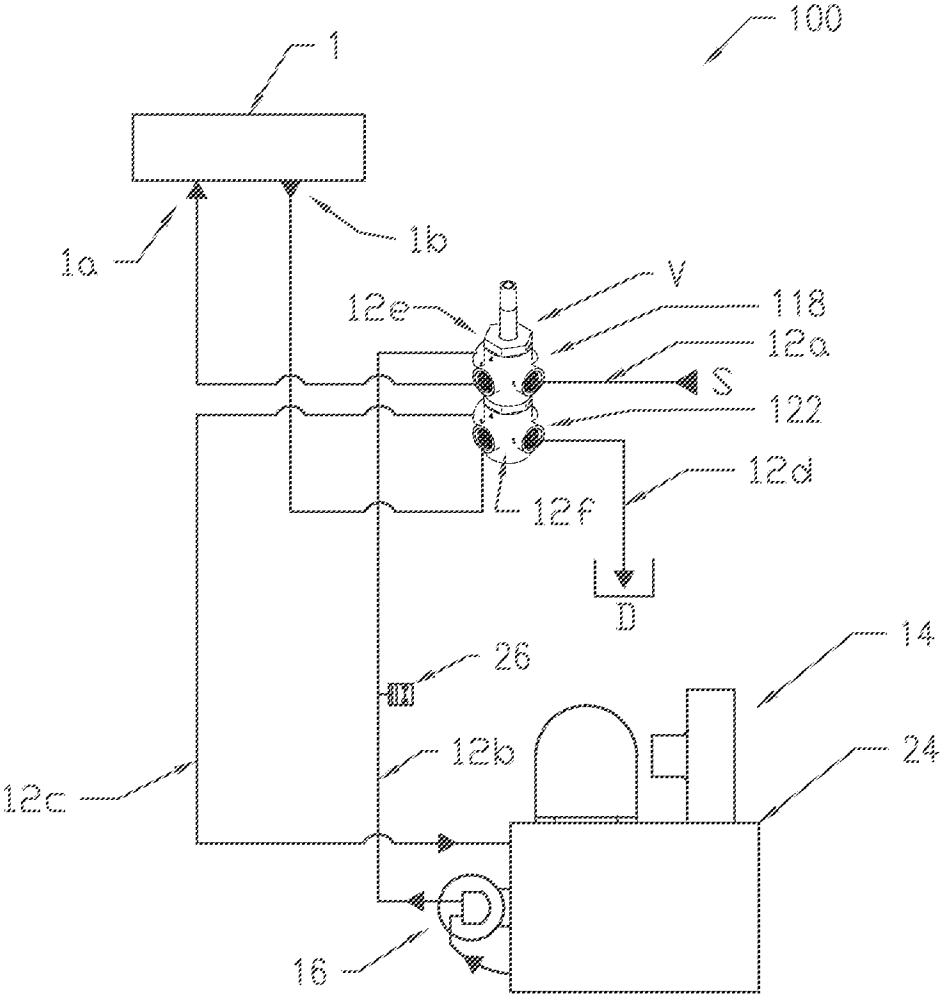
FIG. 4 is a schematic view of a system for cooling the water-cooled apparatus in accordance with another embodiment.

Referring now to FIG. 4, another embodiment of a system is generally shown at 100. For the sake of conciseness, only elements that differ from the system 10 of FIG. 1 are described herein below.

In the depicted embodiment, the system 100 includes a pressure switch 26 that may be used to turn off the pump when the pressure within the circuit 12 increases above 60 psi. The pressure switch 26 is fluidly connected on the second conduit 12*b* that fluidly connects the pump 16 to the water inlet 1*a* of the water-cooled apparatus 1.

In the embodiment shown, the system 100 includes a first three-way valve 118 and a second three-way valve 122. The first three-way valve 118 is located at the intersection 12*e* between the first conduit 12*a* and the second conduit 12*b*. The second three-way valve 122 is located at the intersection 12*f* between the third conduit 12*c* and the fourth conduit 12*d*. In the embodiment shown, the first and second three-way valves 118 and 122 are combined into a same valve body V that is shown enlarged in FIG. 5.

In a particular embodiment, the pressure switch 26 is omitted and a temperature controller may be operatively connected to the valve 118 for opening the valve 118 when the temperature of the water in the circuit 12 reaches a temperature threshold. The pump 16 and the valve 118 may be operatively connected to the temperature controller so that the pump 16 is turned off when the temperature reaches the temperature threshold and the valve 118 is switched to the open configuration when a pressure in the circuit 12 drops.

Figure 5:
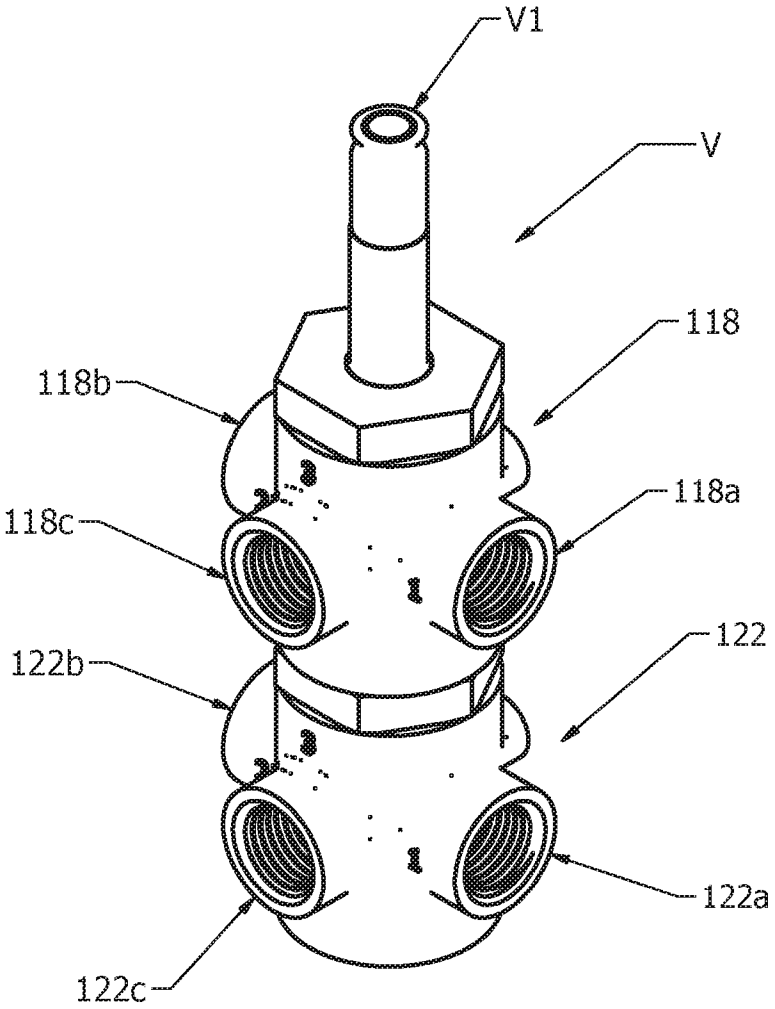
FIG. 5 is a schematic three-dimensional view of a valve that may be used with the system of FIG. 4.

Referring now to FIGS. 4 and 5, the first three-way valve 118 includes a first valve inlet 118*a* that is fluidly connected to the water source S via the first conduit 12*a*, a second valve inlet 118*b* that is fluidly connected to the pump 16 via the second conduit 12*b*, and a valve outlet 118*c* is fluidly connected to the water inlet 1*a* of the water-cooled apparatus 1 via the second conduit 12*b*.

The second three-way valve 122 has a first valve outlet 122*a* that is fluidly connected to the sewer D via the fourth conduit 12*d*. A second valve outlet 122*b* is fluidly connected to the reservoir inlet 24*a* via the third conduit 12*c*. A valve inlet 122*c* is fluidly connected to the water outlet 1*b* of the water-cooled apparatus 1 via the third conduit 12*c*.

Figure 6:
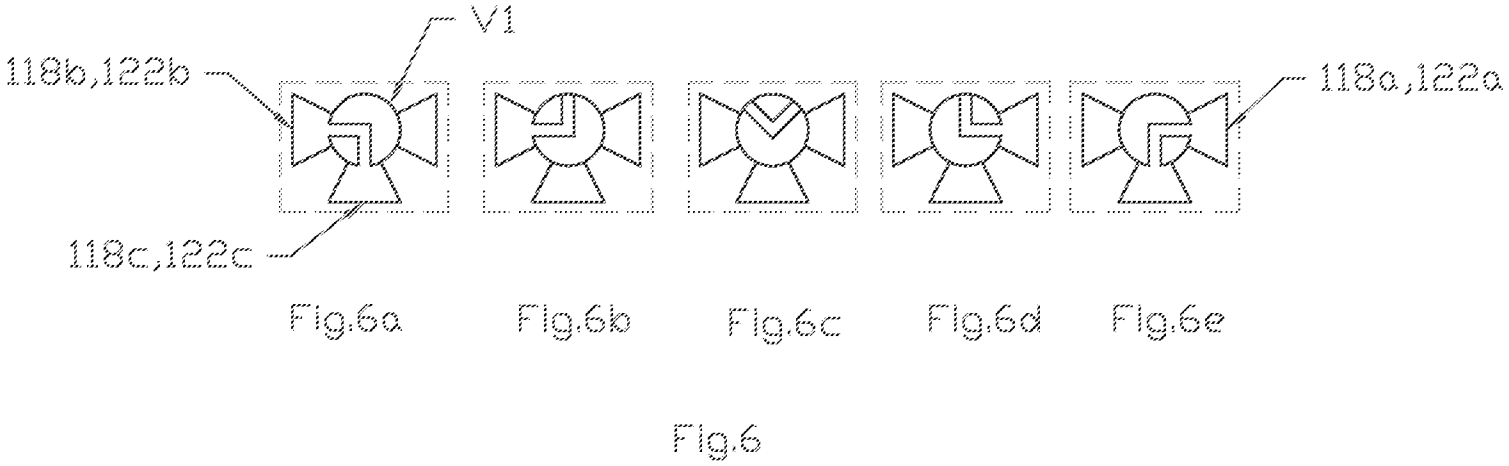
FIGS. 6*a* to 6*e* are schematic cross-sectional views of the valve of FIG. 5 showing different positions of the valve.

Referring to FIGS. 6*a* to 6*e*, the valve body V has a valving member V1 that is movable along a plurality of positions and may simultaneously change the position of both of the first and second three-way valves 118 and 122. As shown in FIG. 6*a*, the position of the valve member V1 allows the fluid connection between the water inlet 1*a* and water outlet 1*b* of the water-cooled apparatus 1 with the reservoir 24 and blocks fluid communication between the water-cooled apparatus 1 and the water source S and the sewer D. In FIG. 6*e*, the valve body V1 allows the fluid connection between the water inlet 1*a* and water outlet 1*b* of the water-cooled apparatus 1 to the water source S and the sewer D, respectively and blocks fluid communication between the water-cooled apparatus 1 and the reservoir 24.

The alternate positions shown in FIGS. 6*b*, 6*c* and 6*d* are deadband positions in which fluid communication in and out of the water-cooled apparatus is blocked. In the depicted embodiment, the one-way valve are not present and replaced by the use of the valve body V.

Figure 7:
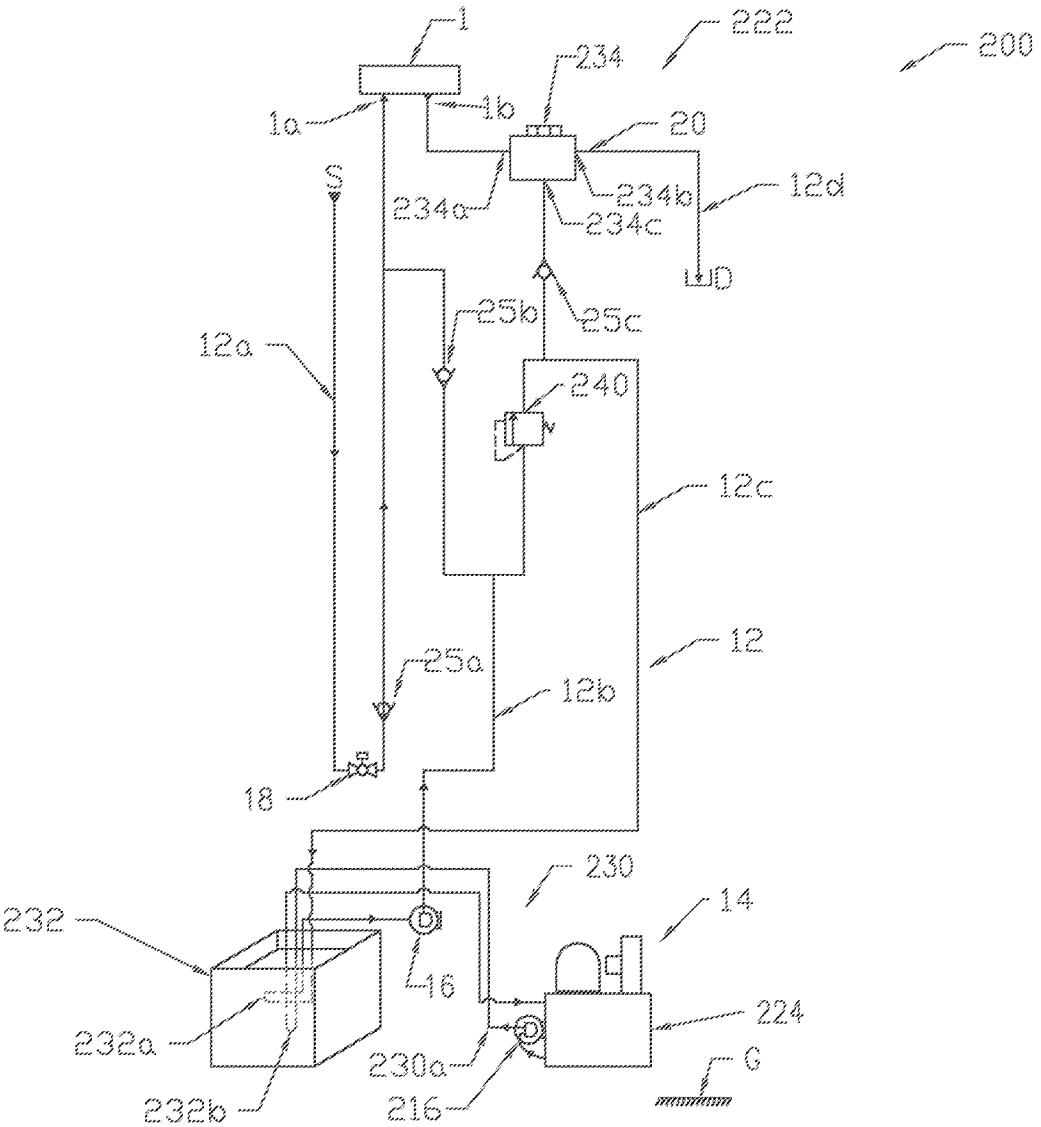
FIG. 7 is a schematic view of a system for cooling the water-cooled apparatus in accordance with another embodiment.

Referring now to FIG. 7, another embodiment of the system is generally shown at 200. For the sake of conciseness, only elements that differ from the system 10 described with reference to FIG. 1 are described herein below.

In the embodiment shown, the system 200 includes a second circuit referred herein as a liquid-coolant circuit 230. The second circuit 230 circulates a liquid coolant and includes a second pump 216 that is fluidly connected to the second circuit 230 for the driving of the liquid coolant within the second circuit 230. The second circuit 230 is in a heat-exchange relationship with the circuit 12, referred herein below with reference to FIG. 7 as the water circuit 12, such that the water in the water circuit 12 is in a heat-exchange relationship with the air-cooled cooling unit 14 via the liquid coolant of the liquid-coolant circuit 230.

For providing the heat-exchange relationship between the water circuit 12 and the liquid-coolant circuit 230 a heat exchanger 232 may be provided. The heat exchanger 232 includes at least one first conduit 232*a* and at least one second conduit 232*b* being in a heat-exchange relationship with at least one first conduit 232*a*. The at least one first conduit 232*a* of the heat exchanger 232 is fluidly connected to the water circuit 12, namely fluidly connected to second and third conduits 12*b*, 12*c* of the circuit 12, whereas the at least one second conduit 232*b* is fluidly connected to the liquid coolant circuit 230. In the particular embodiment, the heat exchanger 232 is a plate heat exchanger. The liquid coolant may be water, a mixture of water and glycol or any other suitable liquid coolant known in the art.

Still referring to FIG. 7, a reservoir 224 contains the liquid coolant of the liquid coolant circuit 230. The air-cooled cooling unit 14 may cool the liquid coolant the same way the air-cooled cooling unit 14 cools the water in the circuit 12 as described herein above with reference to FIG. 1. The liquid coolant that has been cooled within the reservoir 224 is pumped by the second pump 216 out of the reservoir 224 and is directed toward the heat exchanger 232 via a first conduit 230*a* of the liquid-coolant circuit 230. Within the heat exchanger 232, the liquid coolant picks up heat from the water that has been heated in the water-cooled apparatus 1. The liquid coolant that has been thereby heated is redirected back to the reservoir 224 where it is again cooled by the air-cooled cooling unit 14. The water of the water circuit 12 that has been cooled with the liquid coolant of the liquid coolant circuit 230 exits the at least one first conduit 232*a* of the heat exchanger 232 and is directed to the water inlet 1*a* of the water-cooled apparatus 1 via the second conduit 12*b* of the circuit 12. The water is thereby heated within the water-cooled apparatus 1 and is expelled through the water outlet 1*b*. The expelled water is redirected, via the third conduit 12*c* of the circuit 12, to the at least one first conduit 232*a* of the heat exchanger 232 where it transfers its heat to the liquid coolant circulating in the at least one second conduit 232*b* of the heat exchanger 232. The water circuit 12 and the liquid coolant circuit 232 are fluidly disconnected one from the other but are in a heat-exchange relationship with each other via the heat exchanger 232.

In the embodiment shown, the system 200 further includes an accumulator 234. The accumulator 234 is a reservoir that contains a given quantity of water and has an accumulator inlet 234*a* that is fluidly connected to the water outlet 1*b* of the water-cooled apparatus 1, a first accumulator outlet 234*b* that is fluidly connected to the sewer D and a second accumulator outlet 234*c* that is fluidly connected to the third conduit 12*c* of the water circuit 12.

As depicted in FIG. 7, an elevation relative to the ground G of the second accumulator outlet 234*c* is less than the elevation relative to the ground G of the first accumulator outlet 234*b*. The first accumulator outlet 234*b* defines the outlet 20 of the water circuit 12. In a situation where the water circuit 12 is fluidly disconnected from the water source S, a level of water within the accumulator 234 remains substantially constant. If the air-cooled cooling unit 14 is unable to sufficiently cool the water-cooled apparatus, the valve 18 may be opened to allow a flow of water from the water source S to flow into the water inlet 1*a* of the water-cooled apparatus 1 to cool down the water-cooled apparatus 1. In such a case, the level of water within the accumulator 234 might increase until the moment when the level of water reaches the first accumulator outlet 234*b* and excessive water from the water circuit 12 may be expelled via the outlet 20 of the water circuit 12 toward the sewer D.

In the embodiment shown, a water pressure regulator 240 is fluidly connected to the water circuit 12. More specifically, the water pressure regulator 240 is fluidly connected to both of the second and third conduits 12*b*, 12*c* of the water circuit 12. The water pressure regulator 240 may allow water to flow from the conduit 12*b* to the conduit 12*c* if the water pressure in the conduit 12*b* is greater than a determined pressure threshold. The water pressure regulator 240 may allow for a constant pressure in the circuit 12 whether the system 200 is used in the closed-loop configuration or the open configuration. Stated differently, the water pressure regulator 240 may allow the pump 16 to stay operational when the system 200 is in the open configuration. Alternatively, the water pressure regulator 240 may be omitted and the pump 16 may be directly controlled depending of the configuration of the system 200.

In a particular embodiment, the system 200, by having two circuits, namely the water circuit 12 and the liquid-coolant circuit 230, allows to create a fully closed-loop for the liquid-coolant circuit 230 that might avoid risks of flooding that might happen if a mechanical component (e.g., pump 16, reservoir 24, air-cooled cooling unit 14) were to fail. Having the liquid-coolant circuit 232 being a closed-loop fluidly separated from the water circuit 12 may allow to obtain a constant pressure in the liquid-coolant circuit 230. This might benefit the air-cooled cooling unit 14. The separation of the water circuit 12 and the liquid-coolant circuit 230 may allow to use a different liquid (e.g., glycol-water) for the liquid-coolant circuit 230 than that used in the water circuit 12.

Figure 8:
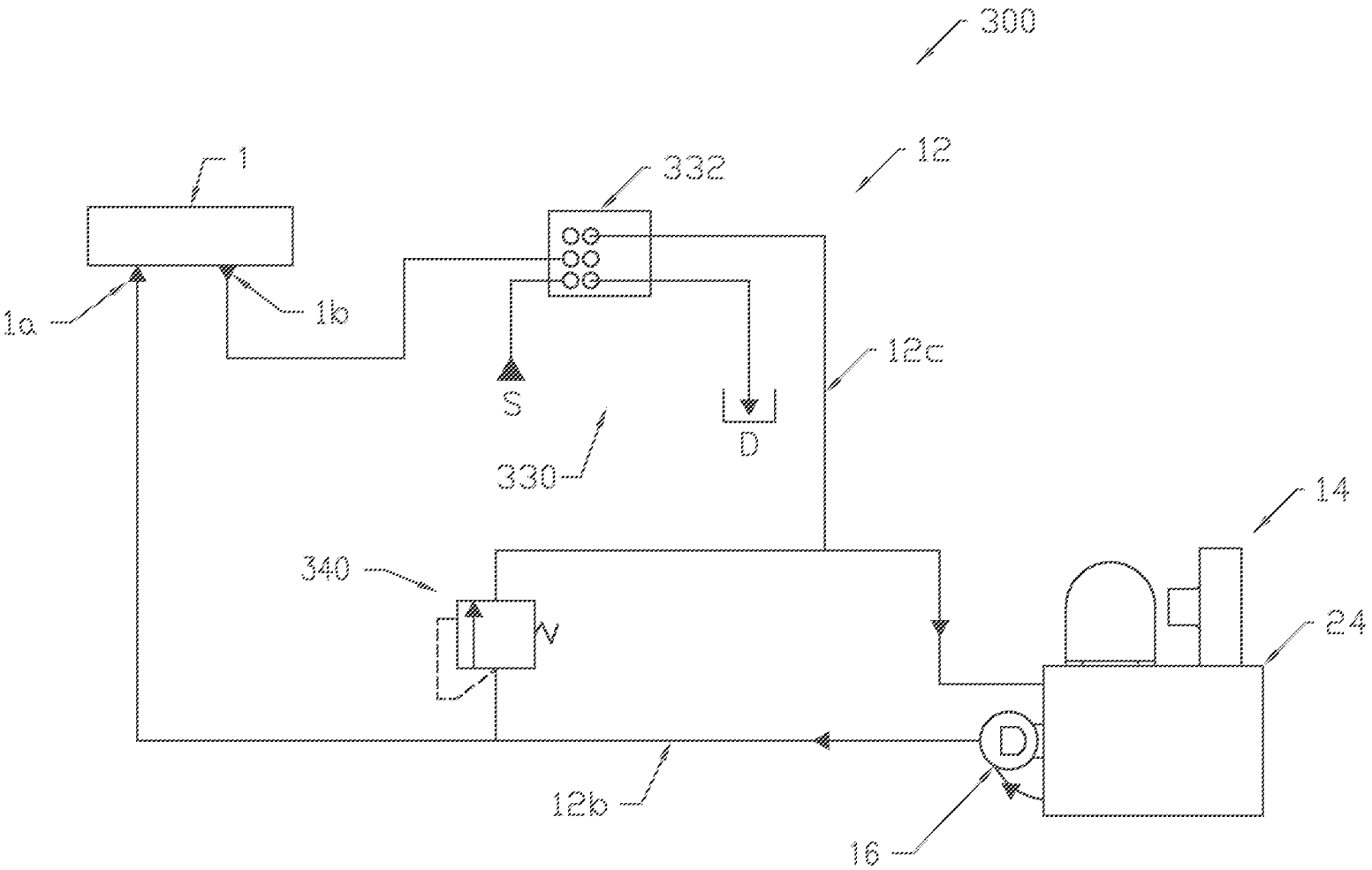
FIG. 8 is a schematic view of a system for cooling the water-cooled apparatus in accordance with another embodiment.

Referring now to FIG. 8, another embodiment of the system is generally shown at 300. For the sake of conciseness, only elements that differ from the system 10 of FIG. 1 are described herein below.

The system 300 includes the water circuit 12 that fluidly connects the reservoir 24 to the water-cooled apparatus 1. In this case, the water from the water source is used to exchange heat directly from the water circuit 12. In other words, the water source S in this embodiment of the system 300 is always fluidly disconnected to the water inlet 1*a* of the water-cooled apparatus 1. As shown in FIG. 8, a second water circuit 330 is in a heat-exchange relationship with the water circuit 12. The second water circuit 330 is fluidly connected to both the water source S and the sewer D. The system 300 includes a heat exchanger 332 which may be similar to the heat exchanger 232 described hereinabove with reference to FIG. 7. The heat exchanger 332 provides a heat-exchange relationship between the second water circuit 330 and the water circuit 12.

The system 300 is operated as follows: the water that has been heated by the water-cooled apparatus 1 is expelled via the water outlet 1*b* and is directed into the reservoir 24 where it is cooled down by the air-cooled cooling unit 14. The water is then redirected by the pump 16 to the water inlet 1*a* of the water-cooled apparatus 1. If the air-cooled cooling unit is insufficient to cool down the water-cooled apparatus 1, the second water circuit 330 is used. Water from the water source S is fluidly directed to the heat exchanger 332 where it picks up heat from the water that has been expelled from the water outlet 1*b* of the water-cooled apparatus 1. The water from the water source, after being heated via its passage to the heat exchanger 332, is ejected into the sewer D.

As for the system 200 described above with reference to FIG. 7, the present system 300 includes a pressure regulator 340 fluidly connected to both of the second and third conduits 12*b*, 12*c* of the water circuit 12.

Figure 9:
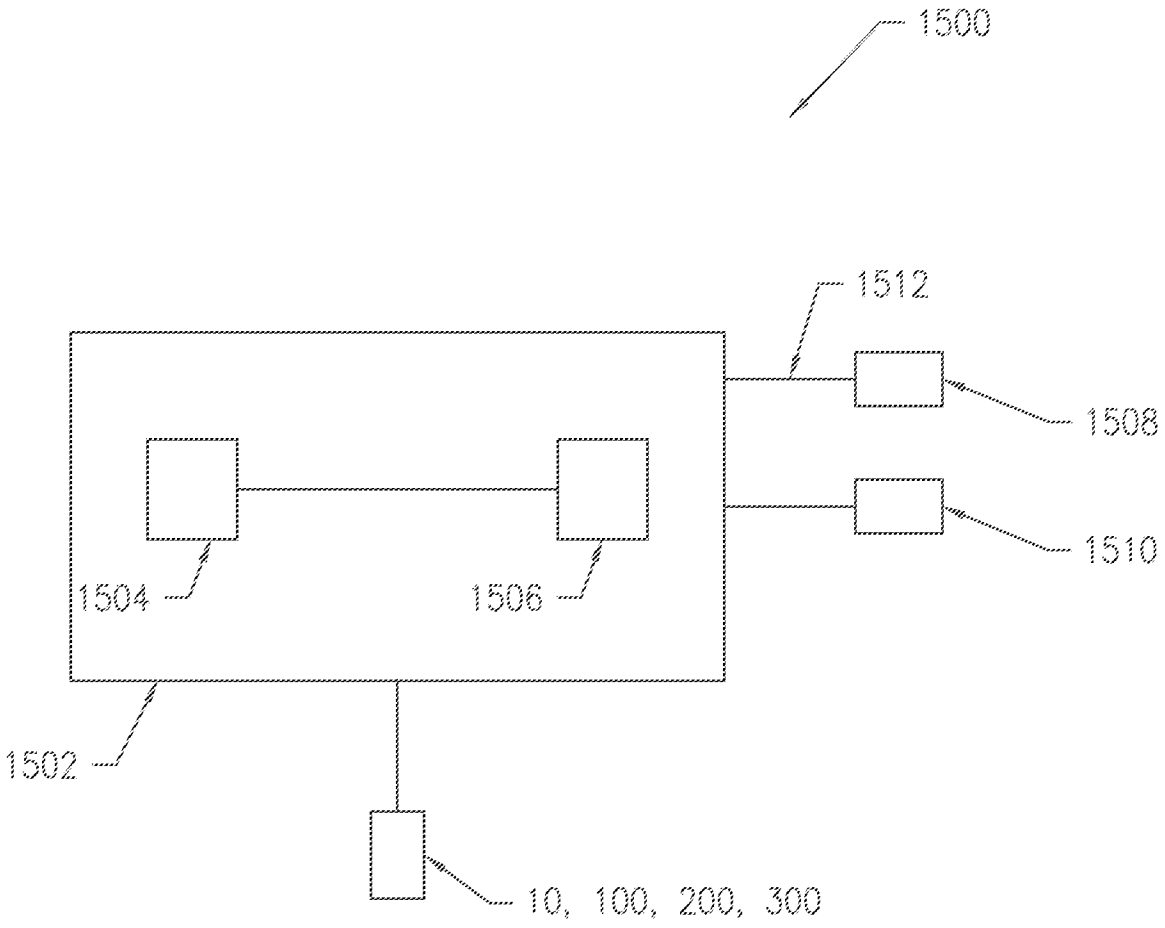
FIG. 9 is a schematic view of a control system for any of the systems of FIGS. 1, 4, 7, and 8.

Referring now to FIG. 9, a control system that may be used with any of the systems 10, 100, 200, 300 describe above is generally shown at 1500.

The control system 1500 includes a controller 1502 that may include a processing unit 1504 and a computer-readable medium 1506 operatively connected to the processing unit 1504. The controller 1502 may have a plurality of sensors, such as a pressure sensor 1508 and/or a temperature sensor 1510, operatively connected to the controller via suitable links 1512, which may be wired or wireless communication links. The sensors 1508, 1510 may be used to measure operation parameters of the system 10, 100, 200, 300 and/or of the water-cooled apparatus 1 to monitor said apparatus. The controller 1502 may be operatively connected to the valves 18, 22 for controlling its opening/closing in function of whether the water-cooled apparatus 1 needs additional cooling power than that provided by the air-cooled cooling unit 14. The temperature sensor 1510 may be disposed in the reservoir 24 to measure a temperature of the water in the circuit 12. Alternatively, the temperature sensor 1510 may be operatively connected to the water-cooled apparatus. The pressure sensor 1508 may be operatively connected to the circuit 12 and may be able to detect a leak or an excess pressure therein and, following such event, revert the system to the open-loop configuration. In a particular embodiment, electric relays may be used to turn on/off the pumps 16, 216. The electric relays may be operatively connected to the controller 1502.

For cooling a refrigerating device, such as the water-cooled apparatus 1, heat generated by the device is transferred to water circulating in the device; the heated water exiting the device is cooled with air; the cooled water is circulated back to the device and repeatedly cooling the heated water exiting the device with air when a temperature of the cooled water is below a temperature threshold; and the device is fluidly connected to receive water from the municipal water source S and to reject the heated water to the sewer D when a temperature of the cooled water is above the temperature threshold.

In a particular embodiment, fluidly connecting the device to receive the water from the municipal water source S when the temperature of the cooled water is above the temperature threshold includes receiving a signal from the temperature sensor 1510. In the embodiment of FIG. 7, cooling the heated water exiting the device with the air includes transferring heat from the water to a liquid refrigerant and from the liquid refrigerant to the air. As shown in FIG. 1, cooling the heated water exiting the device with air includes cooling the water contained within the reservoir 24. In the embodiments of FIGS. 1, 4, and 7, fluidly connecting the device to receive the water from the municipal water source S includes moving the valve 18 from the close position (solid lines) to the open position (dashed line). In a particular embodiment, fluidly connecting the device to receive the water from the municipal water source S when the temperature of the cooled water is above the temperature threshold includes receiving a signal from the device indicative of an operating temperature of the device being above an apparatus temperature threshold. In a particular embodiment, fluidly connecting the device to receive the water from the municipal water source includes sending a signal to switch the valve 18 from the close configuration in which the municipal water source S is fluidly disconnected from the device to the open position in which the water source S is fluidly connected to the device.

In a particular embodiment, the computer readable medium 1506 has instructions stored thereon and executable by the processing unit 1504 for operating the pumps 24, 224, the valves 18, 22, and/or the air-cooled cooling unit 14.

For retrofitting the water-cooled apparatus 1 a closed-loop is formed by fluidly connecting the water inlet 1*a* and the water outlet 1*b* of the water-cooled apparatus 1 in heat exchange relationship with the air-cooled cooling unit 14, and by positioning the valve 18 between the source of water S and the water inlet 1*a* of the water-cooled apparatus 1.

In the embodiment shown in FIG. 1, forming the closed-loop includes fluidly connecting a circuit 12 to the water inlet 1*a* and to the water outlet 1*b* of the water-cooled apparatus 1; the valve 18 being fluidly connected to the circuit 12 and upstream of the water inlet 1*a*. In the embodiment shown in FIG. 1, the water inlet 1*a* is fluidly connected to the water outlet 1*b* via the reservoir 24. As shown in FIG. 1, forming the closed-loop includes positioning the second valve 22 on the circuit 22 downstream of the water outlet 1*b* of the water-cooled apparatus 1. In a particular embodiment, a temperature sensor 1510 is disposed in the reservoir 24 containing the water; the temperature sensor 1510 being operatively connected to the controller 1502 being operatively connected to the valve 18.

The temperature sensor 1510 may be a bulb thermostat and may be used to regulate the forming of the ice block. The temperature sensor 1510 may detect the water temperature and, if needed, activates the air-cooled cooling unit 14 for increasing a volume of the ice block. A pressure regulator/switch may be used to protect the pump 16, 216 and other components of the system to avoid over-pressure. If the pump 16 becomes defective, the pressure regulator/switch may send a signal to a solenoid to switch the valve 18 from the close configuration to the open configuration. A manual security valve may be used to fluidly connect the water source S to the water-cooled apparatus 1 in case of a defective solenoid of the valve 118. In a particular embodiment, the valve 18 is automatically switched from the close configuration to the open configuration when a temperature of the water in the water circuit 12 exiting the at least one first conduit 232*a* of the heat exchanger 232 reaches 24 degrees Celsius. In a particular embodiment, the systems are set so that the water temperature exiting the heat exchanger 232 is 16 degrees Celsius with a tolerance of +/−9 degrees Celsius. It is understood that different temperatures may be set depending of the use of the system.

In a particular embodiment, for installing the systems 10, 100, 200, 300, the water inlet 1*a* is fluidly connected to the water outlet 1*b* of the water-cooled 1 apparatus via the circuit 12; the circuit 12 is fluidly connected to the source of water S via the valve 18; and the outlet 20 of the circuit 12 is fluidly connected to the sewer D for expelling excess water from the circuit 12.

Herein, fluidly connecting the water inlet 1*a* to the water outlet 1*b* via the circuit 12 includes fluidly connecting the reservoir 24 to both of the water inlet 1*a* and the water inlet 1*b* via respective conduits 12*c*, 12*d*. In the depicted embodiment, fluidly connecting the outlet 20 of the circuit 12 to the sewer D includes fluidly connecting the circuit 12 to the sewer D via the second valve 22. In a particular embodiment, a temperature sensor 1510 is disposed in the reservoir 24 containing the water and the temperature sensor 1510 is operatively connected to controller 1502 being operatively connected to the valve 18. In some cases, a wall outlet is installed to provide fluid communication between a room in which the systems 10, 100, 200, 300 is contained and an environment outside the room for expelling excess heat outside the room.

In a particular embodiment, the disclosed systems 10, 100, 200 allows economy in drinking water without having to replace legacy water-cooled apparatus. This might allow a user of the systems to save cost associated with water consumption and to save costs associated with replacing the water-cooled apparatus with an air-cooled apparatus in jurisdiction where open-loop systems are prohibited. In a particular embodiment, since a temperature of the water that has been cooled by the air-cooled control unit 14 is less than that of the water from the source of water S, 58% to 77% less water is required to remove the same amount of heat from the water-cooled apparatus 1 than would be required using the water from the source of water S. In a particular embodiment, the system, when used in the closed-loop configuration, allows to completely avoid using water from the source of water S.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A system for cooling a water-cooled apparatus having a water inlet and a water outlet, the system comprising:

a circuit in fluid communication with the water inlet and the water outlet of the water-cooled apparatus, the circuit having a valve upstream of the water inlet connected to a source of water, and an outlet in fluid communication with a sewer;

an air-cooled cooling unit in heat exchange relationship with water in the circuit; and a pump fluidly connected to the circuit for circulating the water to and from the air-cooled cooling unit;

the system operable between a closed-loop configuration and an open configuration as a function of cooling requirements of the water-cooled apparatus, the valve being closed and the pump circulating water between the water-cooled apparatus and the air-cooled cooling unit in the closed-loop configuration when the water-cooled apparatus has a first cooling requirement, and the valve being open and water in the circuit circulating from the source of water, through the water-cooled apparatus, and to the sewer in the open configuration when the water-cooled apparatus has a second cooling requirement greater than the first cooling requirement.

2. The system of claim 1, wherein the circuit includes a reservoir for containing water, the air-cooled cooling unit in heat exchange relationship with the water in the reservoir.

3. The system of claim 1, further comprising a second circuit circulating a liquid-coolant and a second pump fluidly connected to the second circuit for circulating the liquid-coolant in the second circuit, the second circuit in heat exchange relationship with the circuit such that the water in the circuit is in heat exchange relationship with the liquid-coolant of the second circuit.

4. The system of claim 3, wherein the liquid-coolant is glycol-water.

5. The system of claim 3, wherein the circuit is in heat exchange relationship with the second circuit via a heat exchanger having at least one first conduit fluidly connected to the circuit and at least one second conduit fluidly connected to the second circuit, the at least one first conduit in heat exchange relationship with the at least one second conduit.

6. The system of claim 1, wherein the outlet of the circuit is fluidly connected to a second valve downstream of the water outlet, the second valve being closed in the closed-loop configuration, and the second valve being open in the open configuration.

7. The system of claim 2, wherein the pump has a pump inlet fluidly connected to the reservoir and wherein the reservoir has a reservoir inlet fluidly connectable to the water outlet of the water-cooled apparatus, an elevation from a ground of the pump inlet being less than an elevation from the ground of the reservoir inlet.

8. The system of claim 1, wherein the circuit includes an accumulator having an accumulator inlet fluidly connectable to the water outlet, a first accumulator outlet fluidly connected to the circuit and a second accumulator outlet fluidly connected to the sewer, an elevation relative to a ground of the second accumulator outlet being greater than that of the first accumulator outlet.

9. The system of claim 1, wherein the valve is a three-way valve, the three-way valve having a first valve inlet fluidly connected to the source of water, a second valve inlet fluidly connected to the pump, and a valve outlet fluidly connected to the water inlet of the water-cooled apparatus.

10. The system of claim 9, wherein the outlet of the circuit is fluidly connected to a second valve downstream of the water outlet, the second valve being closed in the closed-loop configuration, and the second valve being open in the open configuration.

11. The system of claim 10, wherein the second valve is a second three-way valve, the second three-way valve having a third valve inlet fluidly connected to the water outlet of the water-cooled apparatus, a second valve outlet fluidly connected to the sewer, and a third valve outlet fluidly connected to an inlet of a reservoir, the reservoir containing water.

12. The system of claim 11, wherein the air-cooled cooling unit is in heat exchange relationship with the water in the reservoir.

13. The system of claim 12, wherein the first three-way valve and the second three-way valve are parts of a single valve body having a valving member, the valving member having a first position in which both of the water inlet and the water outlet of the water-cooled apparatus are fluidly connected with the reservoir through the single valve body and in which fluid communication is blocked between the water-cooled apparatus and both of the water source and the sewer, the valving member having a second position in which the water inlet and the water outlet of the water-cooled apparatus are respectively fluidly connected to the water source and to the sewer through the single valve body and in which fluid communication between the water-cooled apparatus and the reservoir is blocked.

14. The system of claim 1, wherein the air-cooled cooling unit includes a condenser, an evaporator, a compressor, and an electric motor drivingly engaged with the compressor, the compressor being fluidly connected to a refrigerant conduit flowing a liquid refrigerant, the condenser providing heat exchange relationship between the refrigerant conduit and air of an environment, the evaporator providing heat exchange relationship between the refrigerant conduit and water in the circuit.

15. The system of claim 1, comprising a controller having a processing unit and a computer-readable medium operatively connected to the processing unit, the computer-readable medium having instructions stored thereon executable by the processing unit for:

receiving a signal indicative of an operating temperature of the water-cooled apparatus being above an apparatus temperature threshold; and switching the system from the closed-loop configuration to the open configuration.

16. The system of claim 15, wherein the receiving of the signal includes receiving a signal from a temperature sensor and/or a pressure sensor operatively connected to the controller.

17. The system of claim 16, wherein the circuit includes a reservoir for containing water, the air-cooled cooling unit in heat exchange relationship with the water in the reservoir, the receiving of the signal from the temperature sensor includes receiving a signal from the temperature sensor located in the reservoir.

18. The system of claim 16, wherein the receiving of the signal from the temperature sensor includes receiving the signal from the temperature sensor operatively connected to the water-cooled apparatus.

19. A system for cooling a water-cooled apparatus having a water inlet and a water outlet, the system comprising:

a circuit in fluid communication with the water inlet and the water outlet of the water-cooled apparatus, the circuit having a valve upstream of the water inlet connected to a source of water, and an outlet in fluid communication with a sewer;

an air-cooled cooling unit in heat exchange relationship with water in the circuit; and a pump fluidly connected to the circuit for circulating the water to and from the air-cooled cooling unit;

the system operable between a closed-loop configuration and an open configuration, the valve being closed and the pump circulating water between the water-cooled apparatus and the air-cooled cooling unit in the closed-loop configuration, and the valve being open and water in the circuit circulating from the source of water, through the water-cooled apparatus, and to the sewer in the open configuration, wherein the valve includes a first three-way valve and a second three-way valve, the first three-way valve and the second three-way valve are parts of a single valve body having a valving member, the valving member having a first position in which both of the water inlet and the water outlet of the water-cooled apparatus are fluidly connected with the reservoir through the single valve body and in which fluid communication is blocked between the water-cooled apparatus and both of the water source and the sewer, the valving member having a second position in which the water inlet and the water outlet of the water-cooled apparatus are respectively fluidly connected to the water source and to the sewer through the single valve body and in which fluid communication between the water-cooled apparatus and the reservoir is blocked.

20. The system of claim 19, wherein the circuit includes a reservoir for containing water, the air-cooled cooling unit in heat exchange relationship with the water in the reservoir.

* * * * *